United States Patent [19]

Bergman et al.

[11] Patent Number: 4,652,181

[45] Date of Patent: Mar. 24, 1987

[54] STORAGE COMPLEX FOR STORING RADIOACTIVE MATERIAL IN ROCK FORMATIONS

[75] Inventors: Sten G. A. Bergman, Stocksund; K. Ivar Sagefors, Stockholm; Bengt A. Akesson, V. Frölunda, all of Sweden

[73] Assignee: Boliden Aktiebolag, Stockholm, Sweden

[21] Appl. No.: 651,337

[22] Filed: Sep. 17, 1984

[30] Foreign Application Priority Data

Sep. 19, 1983 [SE] Sweden ..... 8305025

[51] Int. Cl.[4] ..... B63G 5/00

[52] U.S. Cl. ..... 405/128; 405/53

[58] Field of Search ..... 405/128, 129, 52, 55; 252/633

[56] References Cited

U.S. PATENT DOCUMENTS

| | | | |
|---|---|---|---|
| 3,068,654 | 12/1962 | Warren | 405/55 |
| 3,608,636 | 9/1971 | Dixon | 405/55 X |
| 4,189,254 | 2/1980 | Akesson | 405/128 |
| 4,192,629 | 3/1980 | Hallenius et al. | 405/128 |
| 4,363,563 | 12/1982 | Hallenius et al. | 405/55 |
| 4,474,506 | 10/1984 | Sagefors | 405/55 |

FOREIGN PATENT DOCUMENTS 2755554 6/1978 Fed. Rep. of Germany ..... 405/128

OTHER PUBLICATIONS

PCT/SE83/00526.

*Primary Examiner*—Dennis L. Taylor

*Attorney, Agent, or Firm*—Burns, Doane, Swecker & Mathis

[57] ABSTRACT

The present invention relates to a storage plant for storing radioactive material in rock formations, the plant comprising a cavity (4) for accommodating radioactive material, the cavity (4) having therearound a rock shield (6) in which a further cavity (7) is optionally formed, there being arranged in the optional cavity a barrier (8) comprising a resilient material which swells in water. Arranged around the second cavity (7) and spaced therefrom is a helical tunnel (12). Entry tunnels (13) extend from the helical tunnel (12), in towards the remaining parts (4,7) of the plant. The invention is characterized in that at least one cage of substantially vertical drill holes (14) is arranged around the plant, preferably in connection with the helical tunnel (12), for taking-up and conducting away water arriving at and departing from the inner part of the storage plant.

18 Claims, 8 Drawing Figures

STORAGE COMPLEX FOR STORING RADIOACTIVE MATERIAL IN ROCK FORMATIONS

DESCRIPTION

1. Technical Field

The present invention relates to a storage complex for storing radioactive material in rock formations, and in particular to a storage complex intended for the long-term storage of spent nuclear fuel derived from nuclear reactors, and such radioactive waste as that obtained when processing spent nuclear fuels.

The object of the present invention is to provide a radioactive material storage complex in rock formations, in which the aforesaid waste nuclear material can be stored for extremely long periods of time, without contaminating the ground-water.

2. Background Art

The fuel elements of a nuclear reactor must be removed after a given period of time has lapsed, and be replaced with fresh fuel. The spent fuel contains uranium, plutonium and fission products. The uranium and plutonium can be recovered by working-up the spent fuel, and then reused. It is not possible, however, with present day working-up techniques to recover all the uranium and plutonium present, and consequently, the working-up process leaves a waste which, together with a large number of fission products, also contains small quantities of uranium, together with plutonium and other transuranic elements. The majority of the waste products are highly radioactive, and decompose and transform gradually to stable basic substances. During the process of decomposition, various forms of radiation are transmitted. The rate of decomposition varies greatly with different waste products, for example from some fractions of a second to millions of years. For example, the half life of plutonium-242 is 380,000 years. Since powerful radioactive radiation is dangerous to living organisms, it is necessary to store highly active waste for extremely long periods of time (thousands of years) in a manner such as to isolate the waste from all living matter.

In the process of working-up the waste, the waste is isolated in the form of an aqueous solution, which is concentrated to the greatest possible extent. This solution, however, is not suited for final storage purposes, and after being left to cool for a suitable length of time, the solution is therefore converted to a solid form. Vitrification is considered the best manner of converting the waste solution to solid form. This process involves evaporating and calcining the waste, which is then heated to a suitable temperature with an addition of glass forming substances. The resultant glass melt is poured into containers, which must then be placed in a suitable storage location.

It has been suggested that the solidified, highly active waste material is ultimately stored in rock caverns located at great depths in primary rock formations. One such proposed storage complex comprises a waste-receiving depot located at ground level. A vertical transport tunnel is drilled from the receiving depot to great depths in the primary rock foundation, while from the lowermost part of the vertical tunnel there is formed a horizontal transport tunnel, in the floor of which there is drilled a plurality of vertically extending holes. The waste containers are transported through the tunnels by means of automatic transport machines, and are inserted as plugs in the holes extending vertically from the floor of the horizontal tunnel. As the holes are filled with waste containers, the mouths of the holes are sealed-off with concrete, for example.

Such a storage complex will effectively shield the radioactive radiation. The primary rock foundation, however, does not comprise a homogeneous material, but normally exhibits cracks and fissures and is often liable to conduct ground-water therethrough. The rock can also be subjected to deforming forces, for example, as a result of earthquakes. Neither can the risk be excluded of deformations occurring over extremely long periods of time. In a storage complex of the aforedescribed kind, such deformations in the bedrock or primary rock formation can result in the fracturing of the waste containers. Moreover, there is a risk that the ground-water will come into contact with the radioactive waste, and therewith spread the radioactive substances in an uncontrollable fashion. The radioactive waste will also generate heat, giving rise to convection currents in the ground-water. The radioactive radiation can also result in the chemical decomposition, so-called radiolysis, of material contacted by the radiation. Radiolysis means that the ambient water will obtain a much higher oxygen content than normal water, and will become highly corrosive. This exposes the capsules in which the radioactive waste is housed to corrosion risks, which may result in the capsules being so eaten away by rust that the waste comes into direct contact with the ground-water.

Plants and complexes for storing radioactive material are known from the Swedish Pat. Nos. SE-C-7613996-3; SE-C-7707639-6; SE-C-7700552-8; and SE-C-7702310-9. Radio active material can be stored in the plants described in these Patent Specifications over long periods of time, without water penetrating the plants.

The storage plants according to the known technique include a hollow body of solid material, the interior of which forms the storage space for the radioactive material. The hollow body is placed in an internal cavity in the rock, the dimensions of said cavity being greater than those of the hollow body, said body being so located in the cavity that a clearance is obtained between the outer surfaces of the body and the sides of the cavity. The interspace between the hollow body and the sides of the internal cavity is filled with a plastically deformable material. Arranged in the rock outside the internal cavity is an external cavity, which surrounds the internal cavity on all sides thereof and which is also filled with a plastically deformable material.

The hollow body is suitably made of concrete, and has an ellipsoidal or spherical shape. The hollow body is made sufficiently strong in this way to withstand the influence of external pressures.

The plastically deformable material, which also swells in water, surrounding the hollow body and filling the outer cavity suitably comprises clay or bentonite. Clay is particularly suitable for this purpose, since it is able to bind radio active fission products by ion-exchange reactions and is but slightly permeable to water. As a result of its plasticity, clay is also able to deform without cracking.

The external surfaces of the hollow body are provided with a layer of heat-insulating material, and coolant-circulating channels may be arranged in said layer. The outer walls of the inner cavity may also be provided with a similar heat-insulating layer.

The interior of the hollow body is suitably divided into a plurality of superimposed chambers, by means of horizontal partitions, said chambers being provided with openings through which radioactive material can be introduced thereinto. This enables the space in the hollow body to be utilised more efficiently, and facilitates the introduction and removal of radioactive material into and out of said body.

There is optionally arranged in the rock mass between the first and the second cavity, a shaft or drift which accommodates control instruments, e.g. instruments for measuring humidity, temperature and radioactive radiation.

The bottom of the outer cavity suitably slopes conically downwards. This facilitates the introduction and compaction of clay, or some other resilient material which swells in water, in the bottom of the outer cavity.

The rock mass located between the inner and the outer cavities becomes totally embedded in the water-swelling, resilient material. This material can be sufficiently load-bearing to prevent the rock from sinking thereinto, although in order to further ensure that the rock will not sink into said material, it may be suitable to stabilise said material by adding thereto a suitable stabiliser in the region beneath the rock mass.

Despite the efficiency of such plants and storage complexes, however, there is a demand for greater security with regard to the reduction in the flow of water therethrough, and therewith with regard to the minimum of risk of contaminating the ground-water.

DISCLOSURE OF THE PRESENT INVENTION

It has been surprisingly found possible to fulfil these requirements by means of a storage complex according to the present invention, and calculations have shown that such a plant or storage complex is able to prevent contact between the radioactive material and the biosphere. Depending upon the selection of a given shielding material, a safe storage time of from six to two thousand million years can be expected, which must be considered sufficient to ensure safe ultimate storage of radioactive material.

The plant according to the present invention for storing radioactive material in rock formations comprises at least one first cavity formed in solid material, the interior of which forms a storage space for the radioactive material, and in which there is optionally formed externally of said first cavity a second cavity which surrounds said first cavity on all sides thereof and which is filled with a water-swelling plastically deformable material, and around which plant there preferably extends a helical tunnel from which access can be had during construction work and from which the interior parts of the plant can be monitored and superintended. The invention is characterised in that there is arranged around the plant, preferably via the helical tunnel, a large number of substantially vertical drill holes forming at least one outer "cage" around said plant, said cage being intended to carry away water arriving at and departing from said plant.

The invention will now be described in more detail with refernce to an embodiment thereof illustrated by way of example in the accompanying drawings.

Figure 1:
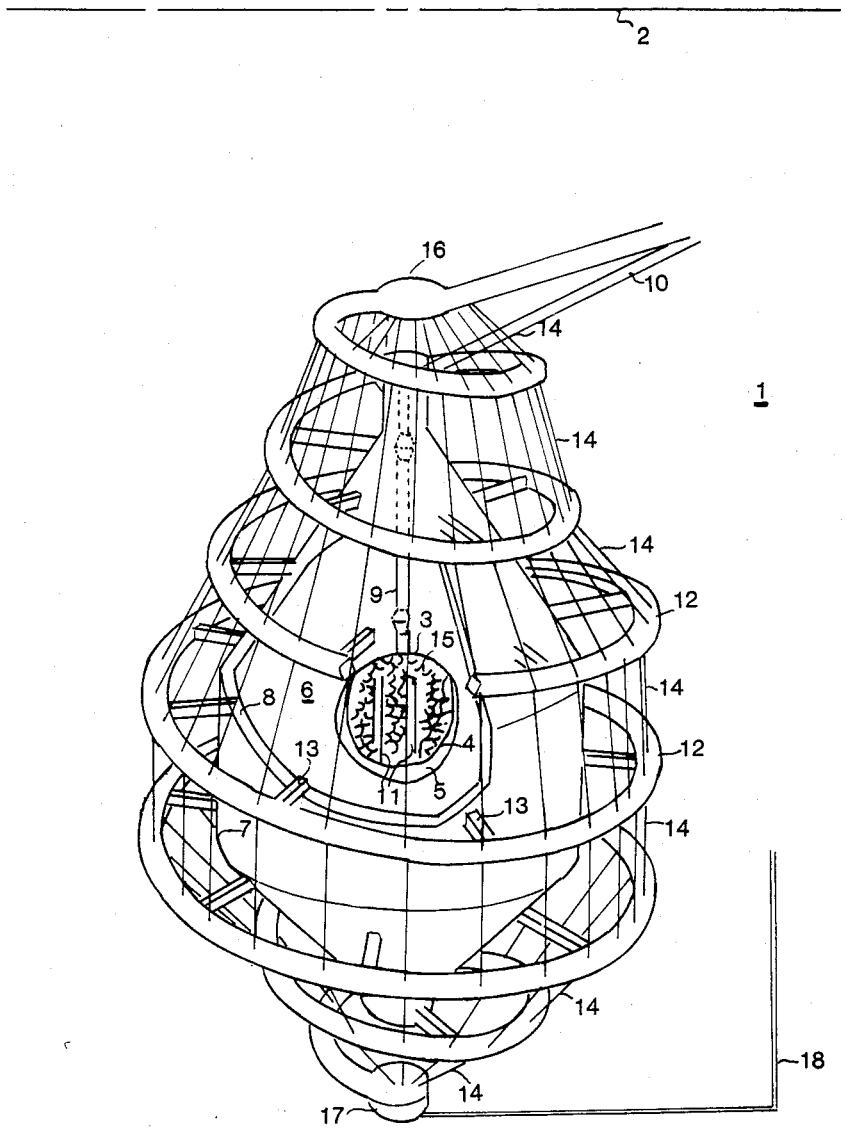
FIG. 1 is a sectional view of a storage plant or complex according to the invention.

In the drawings the reference 1 identifies the bedrock in which the storage plant or complex is located, at a given depth beneath the ground surface 2. Formed in the bedrock is an internal cavity, the outline of which is shown at 3. A hollow body 4, which is made of concrete for example, and the interior of which forms a storage space for the radioactive material, is arranged within the cavity 3 in a manner such that all the outer surfaces of the concrete body 4, are spaced from the walls of the cavity 3. The space between the walls of the cavity 3 and the outer surfaces of the concrete body 4 are filled with clay 5. This inner bentonite shield, including its hollow space, is preferably only used when storing low-active waste, where the thermal load is limited.

The cavity 3 is fully enclosed in rock 6, which in turn is fully enclosed in an outer cavity, the defining contour of which is shown at 7. The outer cavity 7 is also filled with clay 8.

When seen in horizontal section, the cavities 3 and 7 suitably have a circular configuration. In this case, when seen in horizontal section the defining walls 7, 8 of the outer cavity form two mutually concentric circles.

The cavity 4, which has an ellipsoidal, cylindrical or spherical shape, is provided at the top thereof with an opening which communicates, via a shaft 9, with a horizontal tunnel 10. The radioactive material can be conveyed through the tunnel 10 and the shaft 9 into the hollow concrete body 4. The interior of the concrete body 4 is divided by partitions 11 into several chambers, into which the radioactive material is successively introduced. Bodies which contain radioactive material are identified by the reference 15. Certain bodies located in the upper part of the storage plant do not contain radioactive material and are intended to reduce the concentration of heat in the storage plant. The plant can be monitored by means of a television system, having cameras placed in openings and/or in the top of the cavity 4, and by monitors placed at suitable monitoring sites located at a distance from the storage plant.

Extending in the primary rock foundation externally of the actual storage part of the plant is a helical tunnel 12, which extends from the surface of the ground, down to the bottom level 17 of said storage section. The helical tunnel 12 is formed for the transportation of rock debris produced when constructing the storage section of said plant, in which construction galleries and tunnels 13 are drifted from the helical tunnel 12, inwardly towards the centre of said storage section. Located between respective turns of the helical tunnel 12 are drill holes 14, said holes suitably having a centre distance of 1–2 m therebetween. The drill holes 14 suitably open into the outer side of the helical tunnel 12, so as to be interconnected to form a plurality of holes extending substantially vertically from the top 16 of the storage plant to its bottom 17. As a result of these drill holes 14, water running through macro- and microcracks in the surrounding rock will be conducted around the storage plant or down to the bottom level 17 thereof, from where the water can be removed by means of pumps, through a conduit 18 suitably placed in the helical tunnel 12, if so desired. In certain cases, the drill holes 14 can be packed with explosive and blasted, so as to form cracks (so-called pre-splitting) between the drill holes. In this way it is possible to obtain the maximum crack formation towards and between the drill holes, even though those calculations which have been made indicate that the drill holes themselves constitute a fully sufficient hydrological barrier.

The illustrated transport tunnel 10 may be connected directly to a plant for working-up radioactive nuclear fuel. This will reduce the risks associated with the transportation of radioactive waste. The tunnel, however, is not essential to a plant constructed in accordance with the invention. Thus, the aforedescribed shafts can open out into some suitable building for receiving the radioactive waste. This building can be located on the surface of the ground or may be excavated from the rock. A vertical shaft or drift extending up to the horizontal tunnel 10 may be formed in the rock mass 6. The shaft is intended to accommodate measuring apparatuses (not shown) for measuring temperature, humidity and radioactive radiation. These measuring apparatuses may be connected to indicating means in a suitable monitoring station, by means of cables laid in the shaft 9 and the tunnel 10. Measuring apparatus may also be arranged in the tunnel 12.

As will be understood, the storage plant is also provided with suitable elevating (lifts, hoists etc.) and transporting means, for carrying the radioactive waste through the shafts and for distributing the waste in the storage space in the hollow body 4. Such elevating and transporting means are suitably remote controlled, and may be designed in accordance with known techniques, and will therefore not be described in detail here.

The plant can be constructed with the aid of well known rock excavating methods. Firstly, work tunnels, transport tunnels and shafts are drifted in the rock, at those locations where the two cavities are to be sited. Blasting of the two cavities can be effected from below and upwards. The outer cavity 7 is filled progressively with a mixture of bentonite and sand, as the rock debris is removed. The bentonite-sand mixture is packed to a firmness such that no pores remain therein. The clay can be stabilised in an area located furthest down in the outer cavity, by adding a suitable stabilising agent, such as quartz sand, so that the clay can safely support the load of the rock mass 6. When the inner cavity 3 is blasted, a bentonite-sand mixture is first placed on the bottom of the cavity, to a suitable height or depth. The hollow concrete body 4 together with associated shaft 9 is then cast. When the concrete has hardened, the space between the concrete body and the walls of the inner cavity is completely filled with clay. When the plant is finished, the aforementioned work tunnels and transport tunnels can be filled-in with concrete.

Any cracks present in the rock masses located close to the two cavities can be sealed off, by injecting concrete or some other sealing material, such as a plastics material, thereinto.

It will be understood that the storage plant according to the invention may comprise a plurality of shells of different material placed one within the other, namely an innermost concrete shell 4, a first shell 5 of bentonite-sand mixture, a shell 6, comprising rock mass, and a further shell 8 of bentonite-sand mixture, which is completely surrounded by rock.

Figure 2:
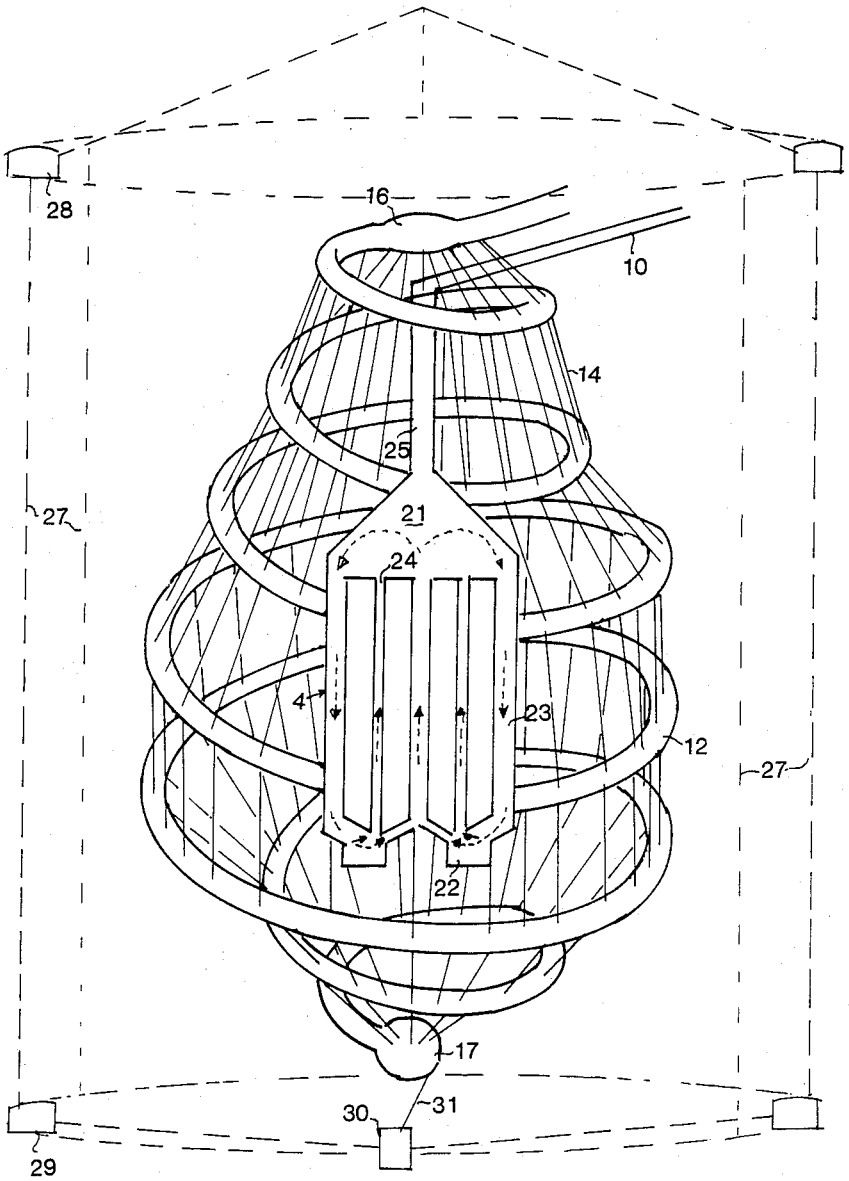
FIG. 2 is a sectional view of an embodiment according to the invention intended for the intermediate storage or ultimate storage of radioactive material.
Figure 3:
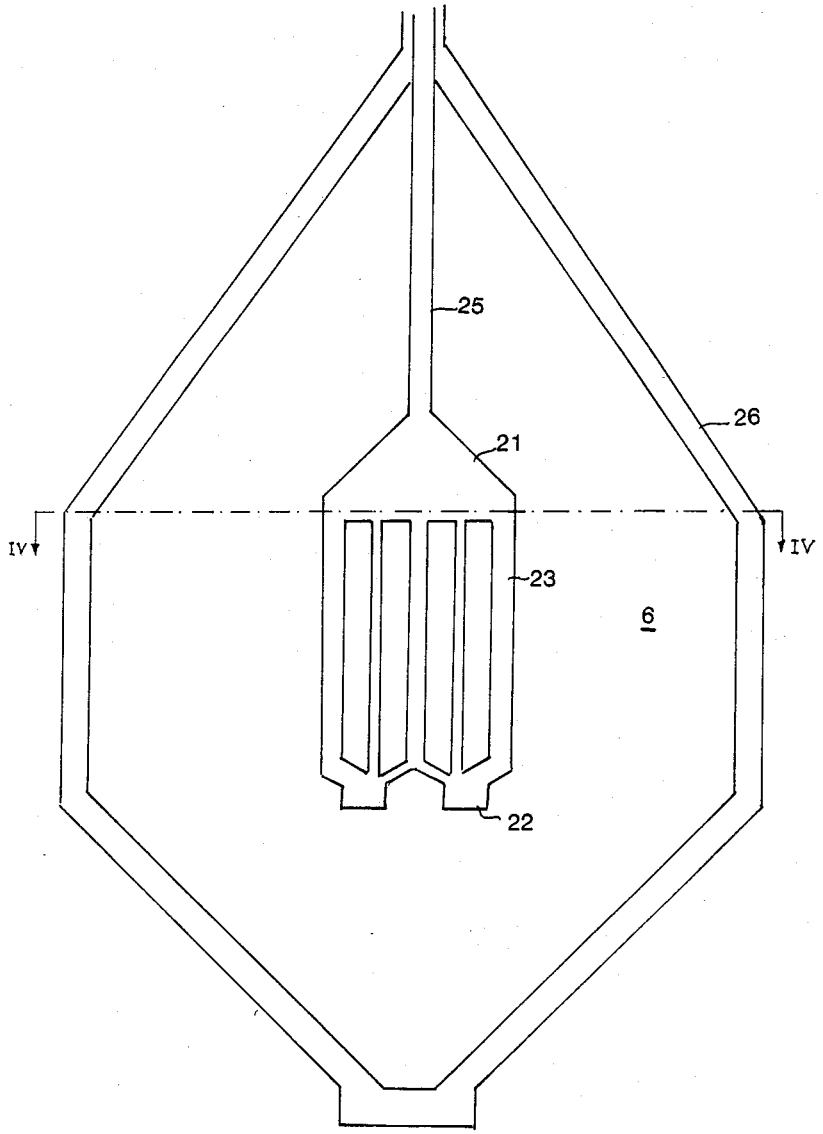
FIG. 3 illustrates the interior of the embodiment shown in FIG. 2, having an external cavity.
Figure 4:
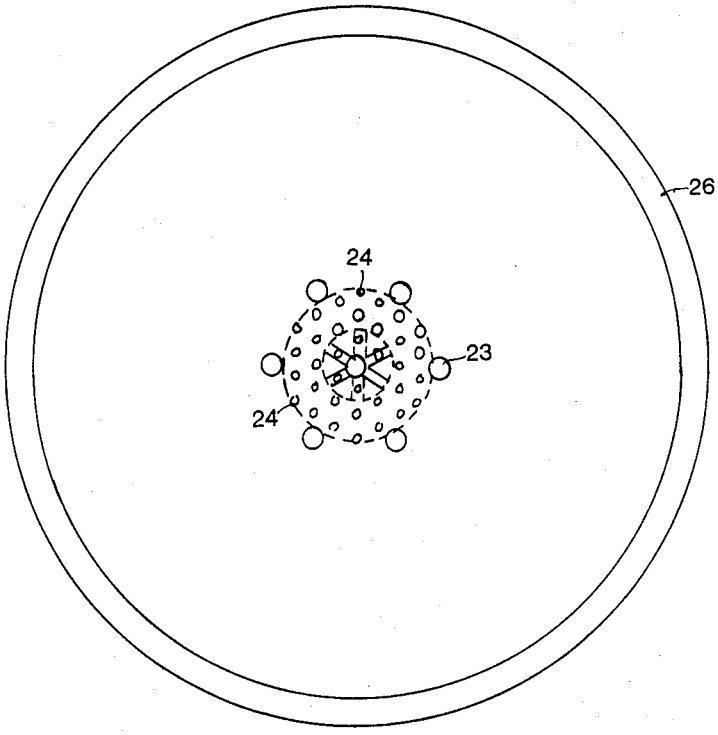
FIG. 4 is a sectional view taken on the line IV—IV in FIG. 3.

The embodiment of the invention illustrated in FIG. 2–4 includes an inner cavity 4, which comprises an open top-space 21 having the form of an open cone formed in the rock, while in the bottom there is arranged an annular tunnel 22. Extending between the annular tunnel 22 and the conical top-space 21 are a number of vertical tunnels 23 of larger diameter, the purpose of which is to provide vents and to permit convection ventilation, to cool the interlying rock material. The interlying rock has also formed therein a plurality of vertical galleries 24 of smaller diameter than the first mentioned vertical tunnels 23. The diameter of the narrower vertical galleries 24 is about 1–1.5 m. while the diameter of the larger vertical tunnels 23 is 2–6 m. These vertical tunnels and galleries can be formed by means of drilling upwardly from the conical top space 21 in accordance with known techniques. The intention is to place radioactive material in the narrower vertical galleries 24, so as initially to obtain the greatest heat emission in the lower part of said galleries 24, air being circulated in said space, as illustrated by the arrows in FIG. 2. The radioactive material is introduced into the top space 21 through vertical shaft 25, and is distributed to the various vertical galleries 24, by means of television monitored robots (not shown).

As will be seen from FIG. 4, the tunnels 23 and the galleries 24 are placed in a circular array, whereby maximum cooling of the rock material is obtained. As a result of placing the radioactive material in a manner such that air can pass through the galleries 24, there is also obtained a primary cooling effect, which means that the load to which the rock material is subjected is smaller than the load of the rock when all heat is conducted away through said rock.

As illustrated in FIGS. 3 and 4, spaced from the inner cavity 4 is an outer cavity 26, which is filled with a plastically deformable material, such as a bentonite-sand mixture.

This bentonite barrier is not provided in the embodiment illustrated in FIG. 2, since in many cases the presence of the outer cage formed by the helical tunnel 12 and the tunnel system connecting the drill holes 14 is sufficient to prevent water penetrating the system, by pumping away said water and/or shunting the same past the storage location.

FIG. 2 also illustrates schematically a further alternative embodiment, in which there is arranged around the storage plant a further barrier of drill holes 27, which can be connected to the aforesaid cage at its bottom level, to evacuate any water penetrating said cage. The drill holes 27 are taken from two annular tunnels 28 and 29 located on a level with the top and the bottom respectively of the storage plant. Arranged on the bottom level of the storage plant is a pump room 30, while a tunnel 31 connects the bottom 17 of the storage plant with the pump room 30.

Alternatively, the area around the drill holes 27 can be presplit.

Should the rock located externally of the storage plant become displaced, settle or be deformed, the resultant movements in the rock will primarily cause deformation of the outer clay shell 8, 26. If this clay shell is sufficiently thick, the deformation forces will not be transferred to the inner shell to any great extent. However, should the rock be deformed to such an extent that the rock shell 6 is also affected, the deformation forces will be further dampened by the inner clay shell 5. The innermost concrete shell 4, which suitably has an ellipsoidal, cylindrical or spherical shape, is extremely strong and resistant to externally acting pressure forces. Consequently, not even extremely powerful deformation forces, for example deformation forces caused by earthquakes, can affect the plant to an extent such as to fracture the innermost concrete shell 4.

Figure 5:
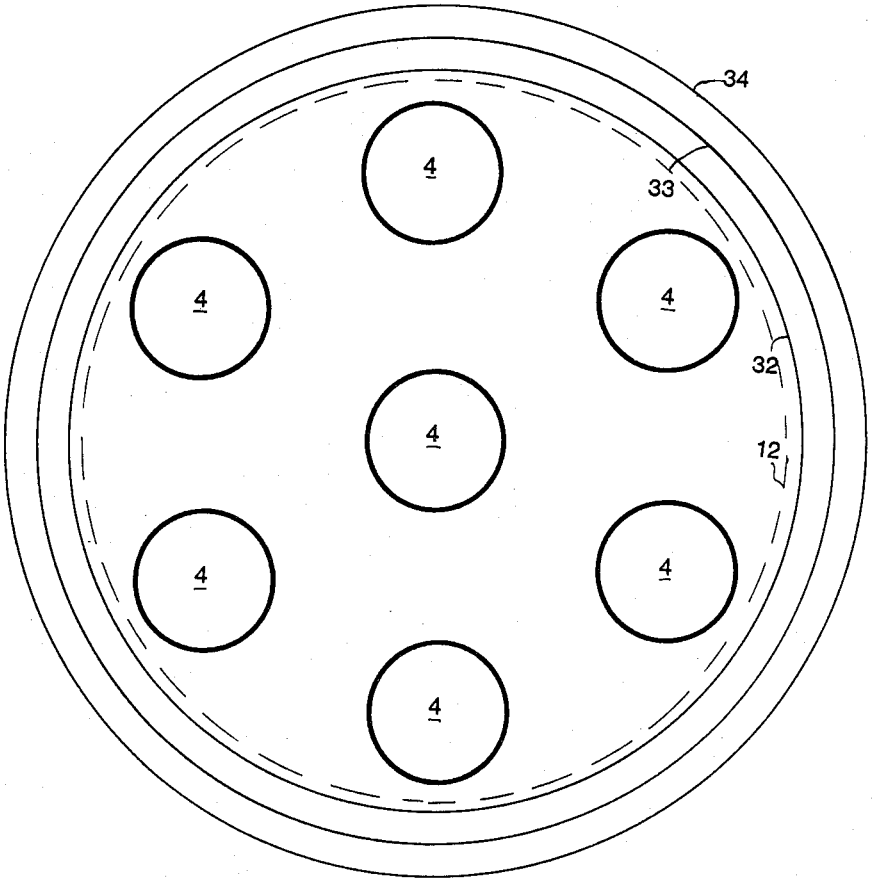
FIG. 5 illustrates an embodiment of the invention having a plurality of collected spaces for accommodating radioactive material.

FIG. 5 illustrates a storage plant according to the invention, in which a plurality of cavities 4, seven in number in the illustrated embodiment, have been collected in the form of a regular hexagon, having a central space. Each cavity 4 covers a diameter of 120 m and is spaced at a distance of 120 m from adjacent cavities. Arranged around all cavities is a helical tunnel 12, through which a first series 32 of vertical drill holes (not shown) is arranged. Two further series 33, 34 of hole curtains are arranged in the rock at a distance of 30 m apart and at a distance of 30 m from the first, inner series of holes.

Figure 6:
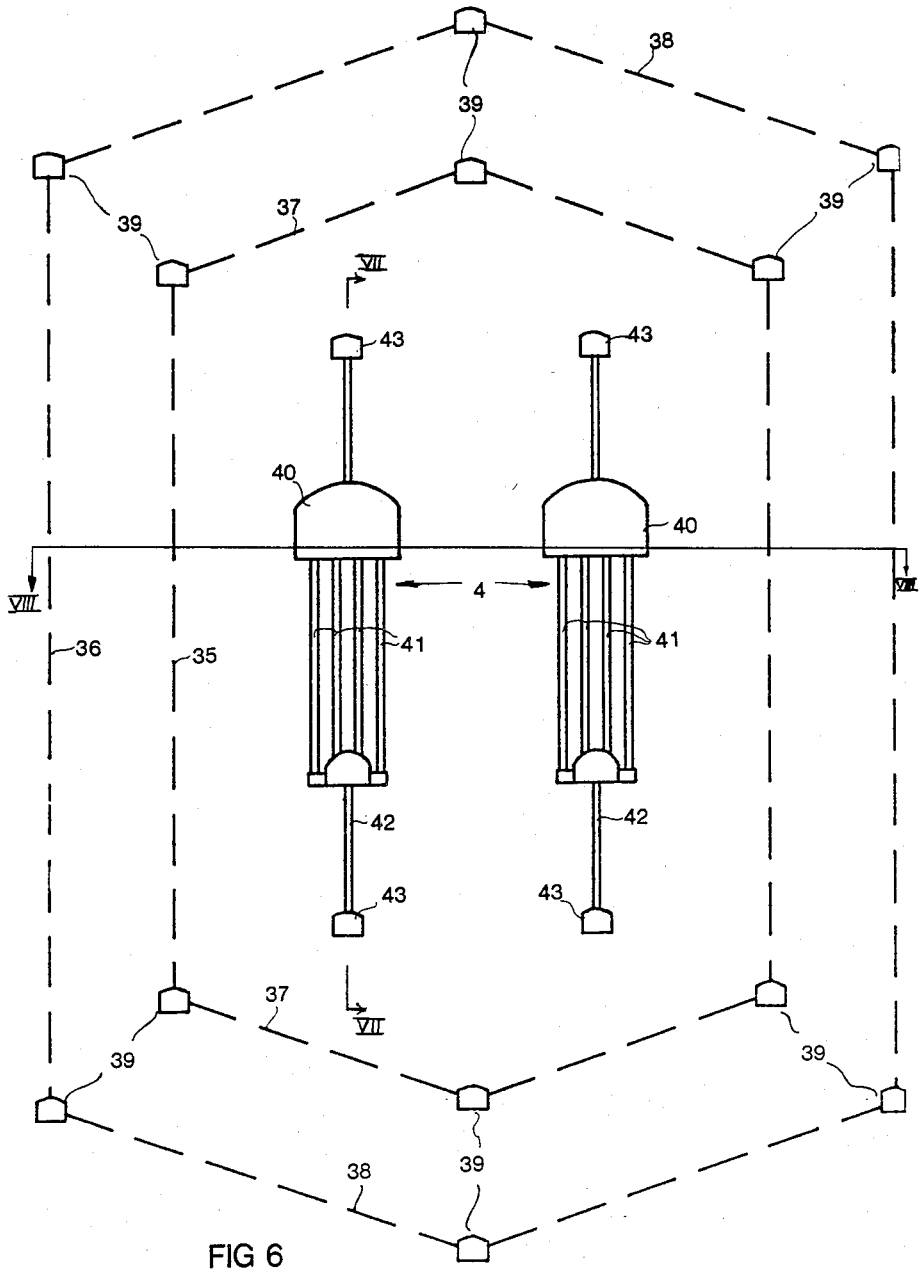
FIG. 6 illustrates in side view a further embodiment of the invention, having two collecting spaces for radioactive material.
Figure 7:
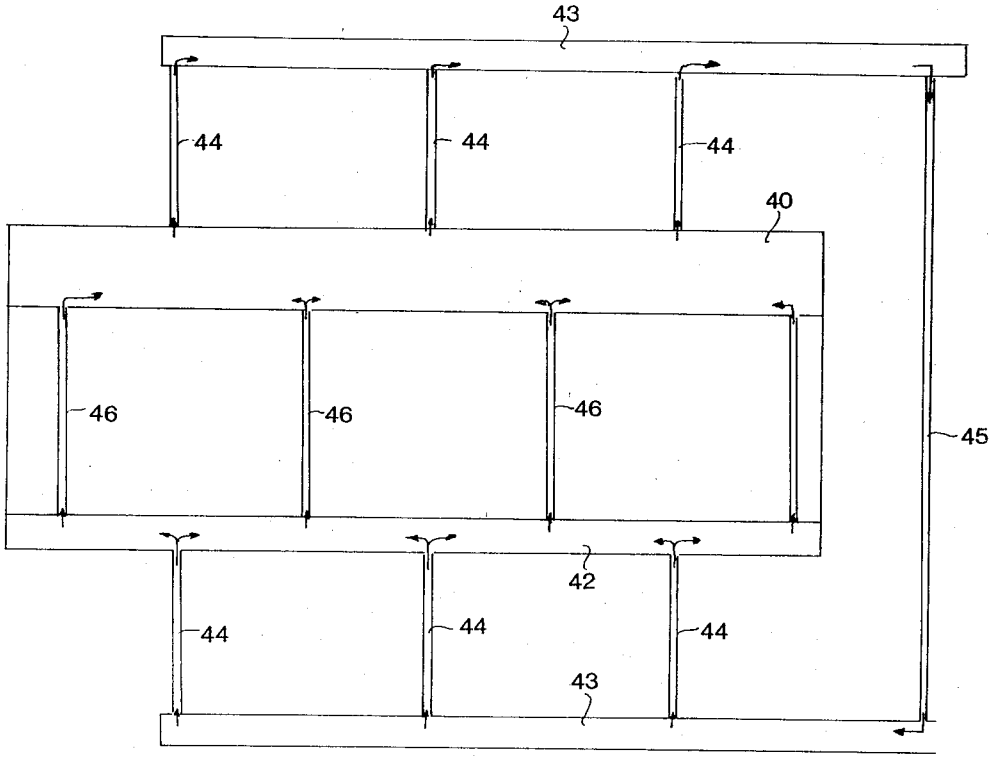
FIG. 7 is a sectional view of the embodiment shown in FIG. 6, taken on the line VII—VII in FIG. 6.
Figure 8:
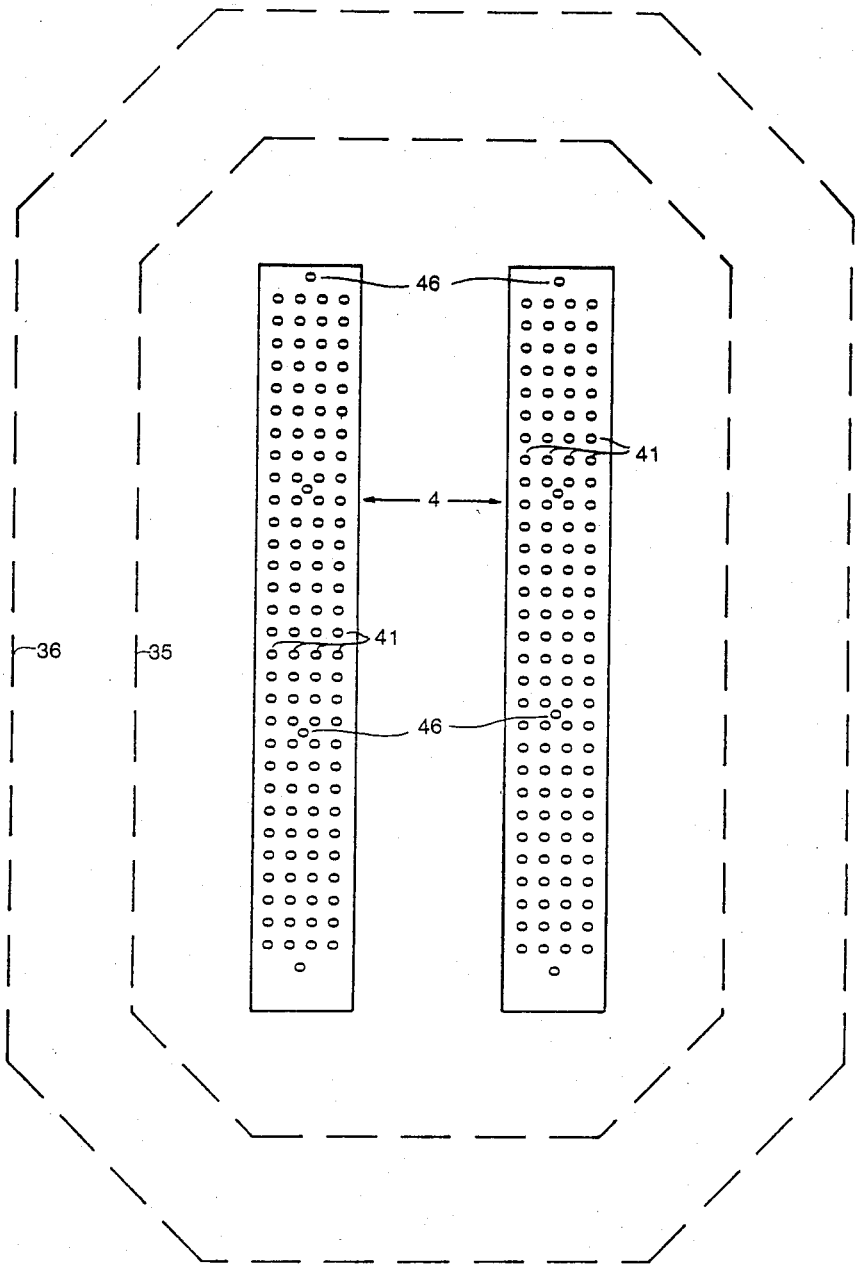
FIG. 8 is a sectional view of the embodiment shown in FIG. 6, taken on the line VIII—VIII in FIG. 6.

FIG. 6 is a vertical sectional view of a storage plant having two storage cavities 4, for radioactive waste. Externally of the two storage cavities 4 are mutually spaced curtains of substantially vertical drill holes 35 and 36, interlinked by obliquely positioned curtains 37 and 38, to form two cages. Drilling of the hole-curtains has been effected by forming twelve horizontal tunnels, all referenced 39. Each storage space 4 comprises an upper, horizontal central tunnel 40, from which a large number of vertical drill holes 31 have been drilled in the rock, said drill holes 41 forming storage spaces for radio active material. Extending beneath all said drill holes 41 is a lower horizontal central tunnel 42, which is arranged to provide for ventilation/air-exchange in the store. Ventilation is further facilitated by providing four vertical larger drill holes 46 in each store, as illustrated in FIGS. 7 and 8. The ventilation is still further facilitated by providing two horizontal top tunnels 43 and two horizontal bottom tunnels 43, which communicate with a respective central tunnel 40 and 42 through vertical drill holes 44. Respective top and bottom tunnels 43 are then connected together by means of a connecting tunnel 45.

The radioactive material to be stored is introduced to the upper horizontal central tunnels 40, through a transport tunnel (not shown) from where the material is introduced into the storage holes 41 by means of TV-monitoring robots. Storage of the material between the holes 41 can also be effected by means of said robots.

The storage plant is suitably built at a great depth in the bedrock. In horizontal section the storage plant has a diameter of about 170 m, the actual central storage body provided with an internal clay or bentonite barrier having a diameter of about 40 m; between this barrier and the second clay or bentonite barrier there is about 40 m of solid rock, after which second barrier there is a further rock barrier of from 15–20 m to the helical tunnel, which has width of 4–8 m.

Depending on whether the storage plant is to be used for the final storage of waste material or for the intermediate storage of said material, and depending on how the plant is ventilated for cooling the radioactive material, said plant is capable of accomodating up to 1,500 tons of radioactive material. The temperature within the rock cavity is calculated to reach a maximum of 180° C. after 10–15 years, although the temperature can be greatly reduced in the case of intermediate storage, when the plant is well ventilated.

We claim:

1. A storage plant for storing radioactive material in rock formations comprising at least one first cavity defined by solid material which cavity forms a storage space for the radioactive material and a plurality of substantially vertical holes which are arranged around said plant, are spaced apart at a distance of up to 4 meters and form at least one outer cage around said plant, said cage being arranged to collect water arriving at said plant.

2. The storage plant of claim 1, wherein the rock located between the holes is presplit to form cracks between said holes.

3. The storage plant of claim 1, wherein the substantially vertical holes are spaced apart at a distance of up to 2 meters.

4. The storage plant of claim 1, wherein the rock located between the holes is presplit to form cracks between said holes.

5. The storage plant of claim 1, wherein the at least one first cavity is surrounded by an outer second cavity which is filled with a plastically deformable material.

6. The storage plant of claim 5, wherein the plastically deformable material comprises clay.

7. The storage plant of claim 1, wherein a helically extending tunnel is arranged around said at least one first cavity.

8. The storage plant of claim 7, wherein the helically extending tunnel is interconnected by said substantially vertical holes.

9. The storage plant of claim 5, wherein a helically extending tunnel is arranged around said outer second cavity.

10. The storage plant of claim 9, wherein the helically extending tunnel is interconnected by said substantially vertical holes.

11. The storage plant of claim 10, wherein additional substantially vertical holes are arranged around said helically extending tunnel to collect water in the vicinity thereof.

12. The storage plant of claim 11, wherein said additional holes are in fluid communication with pump means for carrying collected water away from the plant.

13. The storage palnt of claim 11, wherein the rock located between said additional holes is presplit to form cracks between said holes.

14. The storage plant of claim 8, wherein said substantially vertical holes are in fluid communication with pump means for carrying collected water away from the plant.

15. A storage plant for storing radioactive material in rock formations comprising:

(a) at least one first cavity defined by solid material which cavity forms a storage space for the radioactive material;

(b) an outer cavity which is formed in said rock formation externally of said first cavity and which is spaced from and surrounds said first cavity on all sides thereof, said outer cavity being filled with a plastically deformable material;

(c) a helically extending tunnel arranged around said outer cavity from which helical tunnel access can be had to the outer and inner cavities via a plurality of entry tunnels during construction of a plant and which can be used to permit monitoring of the inner parts of said plant; and (d) a plurality of substantially vertical holes which form at least one outer cage around said plant, said cage being effective to collect water arriving in the vicinity of said plant.

16. The storage plant of claim 15, wherein the substantially vertical holes interconnect said helically extending tunnel and surround said outer cavity.

17. The storage plant of claim 16, wherein the storage plant further comprises pump means for carrying collected water away from the plant.

18. The storage plant of claim 15 wherein the substantially vertical holes are spaced apart at a distance of up to 4 meters.

* * * * *